US007578160B2

(12) United States Patent
Caporusso

(10) Patent No.: US 7,578,160 B2
(45) Date of Patent: Aug. 25, 2009

(54) PIPE-BENDING MACHINE MANDREL

(75) Inventor: Alessandro Caporusso, Piedimonte San Germano (IT)

(73) Assignee: CML International S.p.A., Piedimonte San Germano (IT)

( * ) Notice: Subject to any disclaimer, the term of this patent is extended or adjusted under 35 U.S.C. 154(b) by 0 days.

(21) Appl. No.: 11/972,057

(22) Filed: Jan. 10, 2008

(65) Prior Publication Data

US 2008/0168820 A1 Jul. 17, 2008

(30) Foreign Application Priority Data

Jan. 11, 2007 (IT) ..... RM2007A0015

(51) Int. Cl.
*B21D 9/03* (2006.01)
*B23P 23/04* (2006.01)

(52) U.S. Cl. ..... 72/466; 72/466.2; 72/478

(58) Field of Classification Search ..... 59/78.1; 72/150, 369, 466, 466.2, 478, 480
See application file for complete search history.

(56) References Cited

U.S. PATENT DOCUMENTS 2,444,907 A * 7/1948 Attridge ..... 72/466
3,490,259 A * 1/1970 Cwik ..... 72/466
4,123,930 A 11/1978 Hill et al.
4,671,096 A * 6/1987 Crosby, Jr. ..... 72/466
5,909,908 A * 6/1999 Furuse ..... 72/466.2
7,272,922 B2 * 9/2007 Fahrion ..... 59/78.1
2006/0053854 A1 3/2006 Nakazato

FOREIGN PATENT DOCUMENTS

DE 1090933 10/1960
JP 08294731 11/1996

OTHER PUBLICATIONS

European search report dated Ju. 10, 2008.

* cited by examiner

*Primary Examiner*—David B Jones
(74) *Attorney, Agent, or Firm*—Young & Thompson

(57) ABSTRACT

A pipe-bending machine mandrel includes a rigid member (5), inserted inside a pipe (T) which has an internal dimension Di and can tilt in a bending operation with a mean radius Rm as measured between the rotation center (O) of a bending die and the longitudinal axis (l) of the pipe (T). The rigid member (5) has a proximal side profile with respect to the rotation center (O) and includes a concave intermediate portion as generated by a radius Rci, and a distal side profile with respect to the rotation center (O) that includes two convex, divided, end portions as generated by respective radius Rce, where Rci=Rm−(Di/2)+t, and Rce=Rm+(Di/2)−t, t being a term varying according to the accuracy of the dimensional characteristics of the pipe and of the curve to be obtained.

8 Claims, 4 Drawing Sheets

PIPE-BENDING MACHINE MANDREL

BACKGROUND OF THE INVENTION

1. Field of the Invention

The present invention relates to a pipe-bending machine mandrel.

2. Description of Related Art

The mandrels are devices that are used inside pipes to be bent in order to prevent defects and distortions of the pipes in a bending operation.

By way of example, U.S. Pat. No. 5,909,908, which was granted on Jun. 8, 1999, describes a combined punching and bending apparatus to punch and bend a pipe, in which a core bar that is supported at an end of a rod comprises a main body and two rigid members, which are articulated to the main body in sequence and are designed to tilt together with a correspondent section of the pipe being bent.

Such rigid members, which are designed for rectangular pipes in the cited document, are of prismatic shape, are chamfered at their ends, and have transversal dimensions that are slightly less than the dimensions of internal cross-section of the pipe to allow the mandrel to slide with respect to the pipe. In the bending operation, the internal walls of the pipe, i.e. both the proximal one and the distal one with respect to the bending centre, are in contact with the rigid articulated members only along a line, since the rigid articulated members have straight side surfaces, and the pipe is bent according to any desired bending radius Rm. Bending radius Rm means the distance as measured between the centre of a bending die, by which the pipe is bent, and the external edge of the same bending die, i. e. between the centre of the bending die and the centre of the pipe to be bent.

However, a large range, in which the same mandrel is used with different-radius bending operations, has, as a negative set-off, distortions and defects that are shown by the generation of flattening, bulges or wrinkles in the bent section of the pipe. In other words, the same profile that a bent pipe had before the bending operation cannot be kept after it.

Japanese Patent Application No. 2005-205482, that was filed on Jan. 26, 2004, describes a pipe-bending mandrel having a tilting member in its front end opposite to a mandrel holding rod, tilting member which is pivoted between two side ends. In their distal side, i. e. in the side far from the rotation centre of the bending die, the side ends are configured like a surface that the pipe will get on that side at the end of the bending operation.

In the above cited Japanese Patent Application the tilting member has a substantially straight distal side, which is parallel to the pipe before the pipe is bent. This distal side is radiused both in front and at the rear to abut against the pipe on two points. The proximal side of the tilting element is conformed like a surface which the pipe will exhibit on that side at the end of the bending operation. In such a way, the pipe to be bent is not supported suitably throughout the bending operation. Further, the mandrel consists of mutually moveable parts, and this makes the mandrel weak and wearable over the time. Furthermore, the mandrel according to the cited Japanese Patent Application has one working position whereby an operator has to be careful that in operation the tilting member is perfectly coplanar with the bending die.

To overcome the drawbacks of the prior art, an object of the present invention is to manufacture a pipe-bending machine mandrel having either an integral rigid member or a rigid member which is comprised of a plurality of parts which are securely connected together in one body, that depends on a radius of a curve at which a section of pipe has to be bent.

SUMMARY OF THE INVENTION

Another object of the invention is to conform and size a rigid member of a pipe-bending machine mandrel according to the internal diameter or the internal transversal dimension of the pipe to be bent.

Therefore, the present invention provides a pipe-bending machine mandrel comprising a rigid member, which can be inserted inside a pipe to be bent and can tilt herewith in a bending operation which is performed by a bending die in order to obtain a curve having a prefixed mean radius Rm as measured between the rotation centre of the bending die and the longitudinal axis of the pipe to be bent, said mean radius Rm and longitudinal axis lying in a central plane orthogonal to a symmetry plane of the pipe to be bent passing through its longitudinal axis, said pipe to be bent having an internal dimension Di as measured transversally to its longitudinal axis, said rigid member having a proximal side profile with respect to the rotation centre of the bending die comprising at least a concave intermediate portion as generated by a radius Rci section of circumference, and a distal side profile with respect to the rotation centre comprising at least two convex, divided, end portions as generated by respective radius Rce section of circumferences, where $Rci=Rm-(Di/2)+t$, and $Rce=Rm+(Di/2)-t$, t being a term varying according to the accuracy of the dimensional characteristics of the pipe to be bent and of the curve to be obtained.

In more detail, the term t considers the allowance of the pipe to be bent and of the rigid member as well as the total length of the rigid member and single portions thereof, and also the mean radius Rm, for permitting the rigid member and the pipe to be bent to be moveably coupled both before and after the bending operation.

For an easy construction, the rigid member can have side profiles that are symmetrical with respect to said symmetry plane of the pipe to be bent, each side profile comprising a concave intermediate portion between two convex end portions, the intermediate portion being mutually radiused to the two end portions of the rigid member, which in turn are chamfered at the ends of the rigid member.

In a case of a pipe to be bent having a round cross-section, e.g. circular or elliptical, the intermediate portion and the end portions of the rigid member are rotation surfaces as generated by the rotation of said sections of circumference about the central longitudinal axis of the rigid member. If the pipe to be bent has a quadrangular cross-section, such as square or rectangular one, the intermediate portion and the end portions of the side profile of the rigid member are cylindrical extrusion surfaces as generated by shifting said section of circumference parallel to the symmetry plane of the pipe to be bent. In the first case, the rigid member has substantially the shape of a small barrel having sinusoidal side walls, and in the second case the rigid member has the shape of a prism having sinusoidal side walls.

It is appreciated that in either case, i.e. round pipe and square pipe, the rigid member has a proximal side profile, i.e. the nearest one to the centre of the bending die, said proximal side profile having an intermediate concave portion on which the internal section of the pipe to be bent is adapted. Analogously, the distal side profile of the rigid member has convex end portions, on which the external section of the pipe to be bent is substantially adapted.

In such a way, the rigid member has, on one hand, a couple of divided surfaces that counteract an undesired deformation of the pipe to be bent, said divided surfaces having a curvature radius generally equal to that of a curve on the extrados portion of the pipe to be bent, and, on the other hand, only one surface counteracting that deformation, said only one surface having a curvature radius generally equal to that of a curve on the intrados portion of the pipe to be bent.

Therefore, the rigid member operates like a gauge to keep the same cross-section of the pipe also after the bending operation. Such an operation allows the friction between the surfaces of the rigid member to be reduced. As a result materials are subjected to lower stresses, and this is particularly advantageous e. g. because less strong materials can be used for the rigid member and the connecting parts thereof.

BRIEF DESCRIPTION OF THE DRAWINGS

These and other objects, characteristics and advantages will be more clear from the description of the present invention with the reference to preferred embodiments thereof, with connection to the enclosed drawing, in which.

DESCRIPTION OF THE PREFERRED EMBODIMENTS

Figure 1:
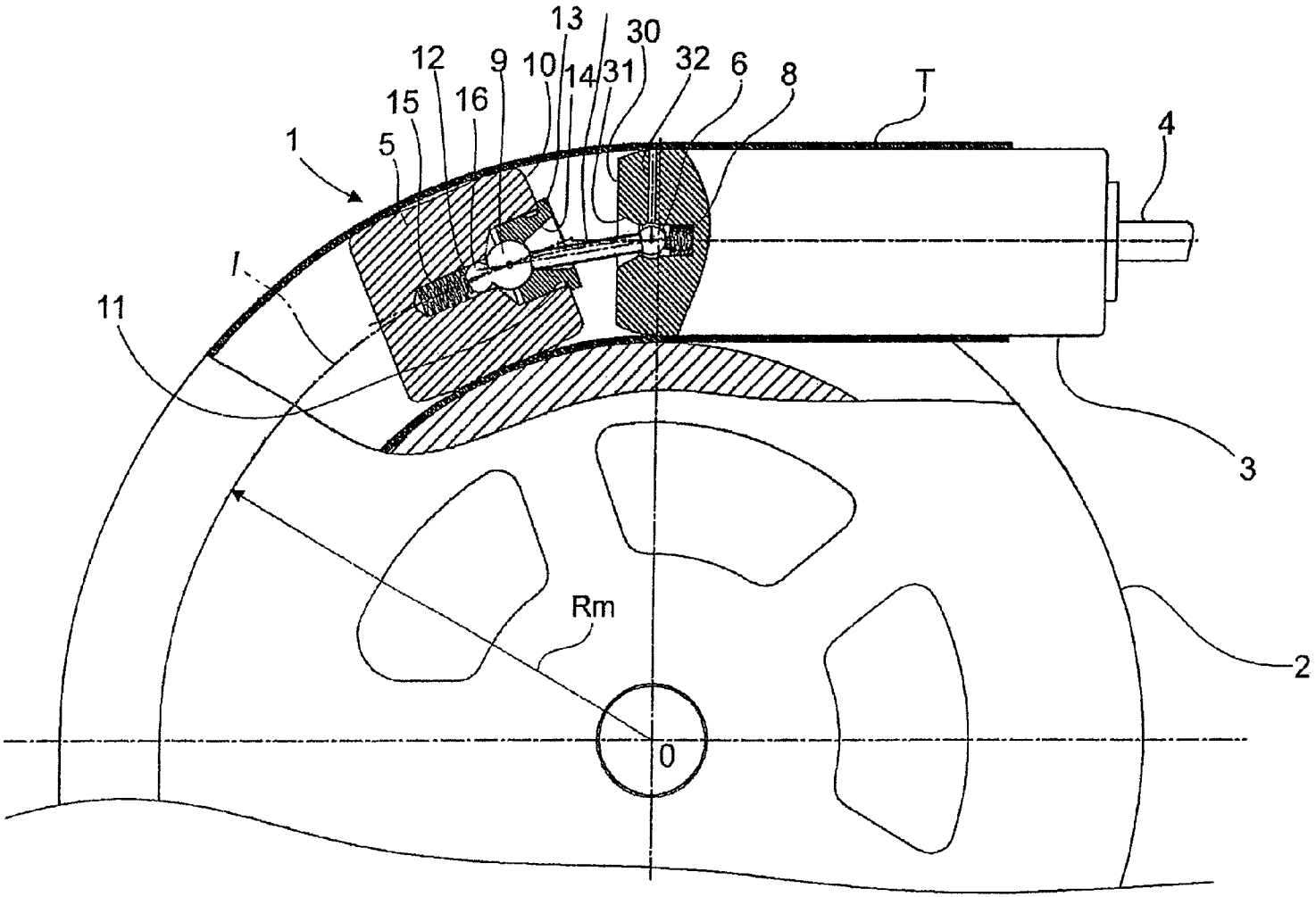
FIG. 1 shows in a fragmentary, partially cross-sectioned plan view, a pipe-bending machine mandrel according to the present invention inside a pipe after a bending operation to 90 degrees of the same, and a bending die that generated the curve.

With reference to the drawings, FIG. 1 shows in a fragmentary, partially cross-sectioned plan view, a pipe-bending machine mandrel 1 according to the present invention inside a pipe T after a bending operation to 90 degrees of the same. The operation is performed by a bending die 2 and a counter bending die, not shown, in a pipe-bending machine, also not shown. The cross-section of the pipe T can be round, such as circular or elliptical, but also quadrangular of e. g. a square or rectangular shape.

By way of example, the mandrel 1 comprises a not flexible main body 3, which is supported by a mandrel holding rod 4, only partially shown, and a rigid member 5 at a front end 30 of the not flexible main body 3. Other rigid members as that one shown could be connected sequentially but they are not shown for clarity sake. The rigid member 5 is connected to the not flexible body 3 by ball joints, as it will be described in detail below. However this connection can be made in a flexible way, for example by means of a wire, and in other ways.

Figure 2:
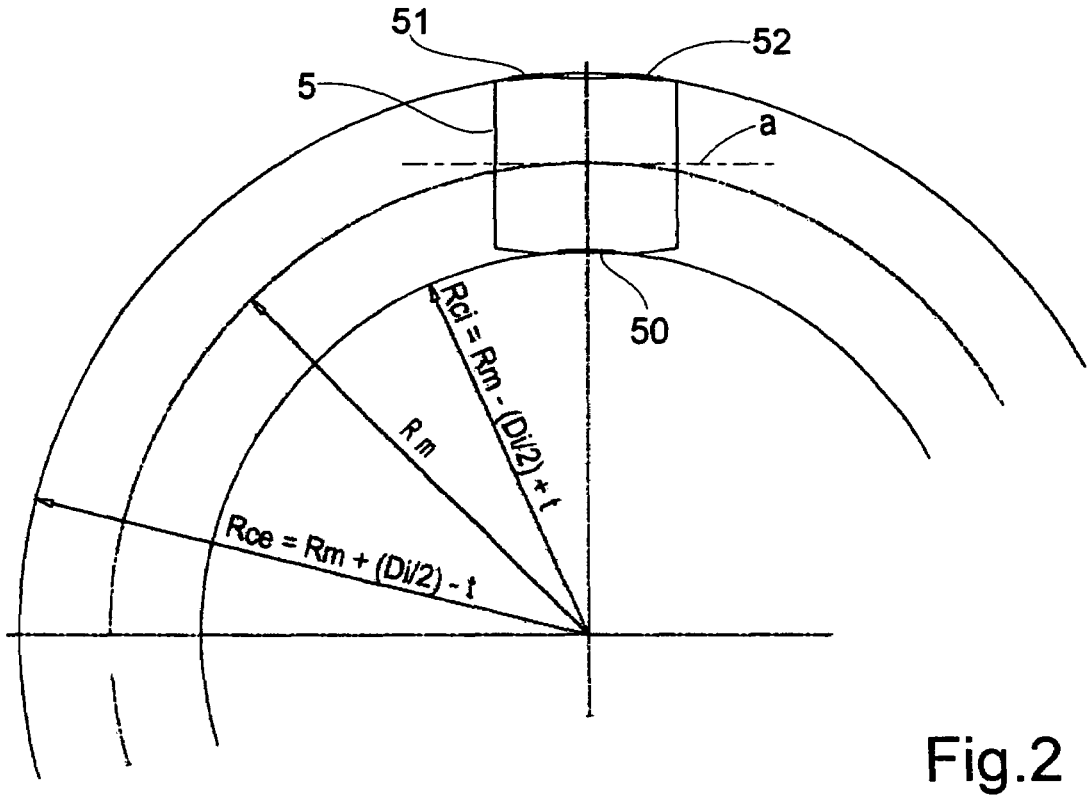
FIG. 2 shows in a diagrammatic view a theoretical construction of a rigid member for the pipe-bending machine mandrel in FIG. 1.
Figure 3:
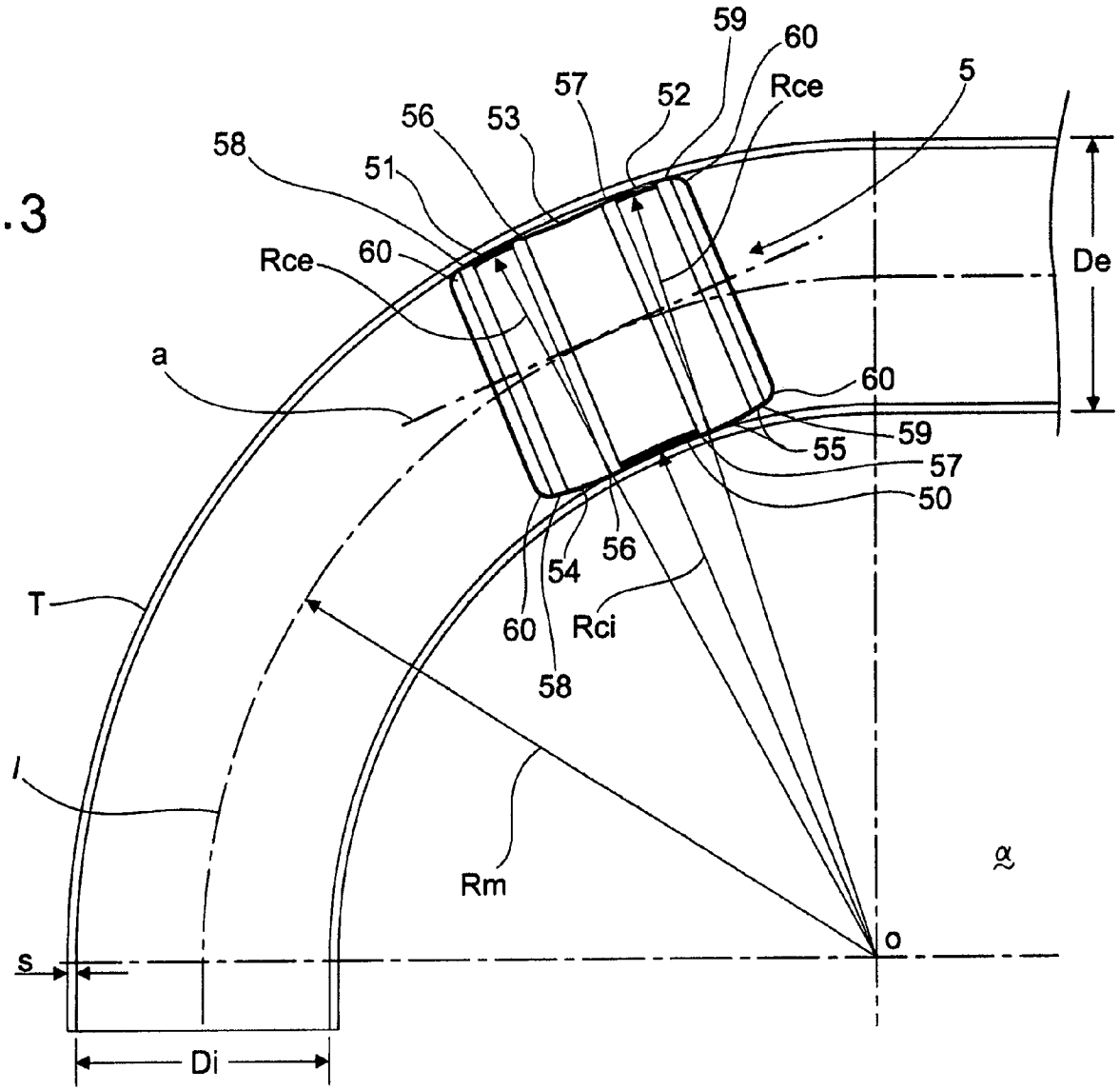
FIG. 3 shows in a ghost diagrammatic view a real construction of the rigid member in FIG. 1, inside a pipe T.

Reference is made now to FIGS. 2 and 3, in which a theoretical construction and a real construction of the rigid member 5 inside the pipe T in FIG. 1, are shown in a diagrammatic view and in a ghost diagrammatic view, respectively. Di is assumed as the internal diameter or the internal transversal dimension of the pipe T to be bent, s is the pipe thickness, and De=Di+2s is the external diameter or the external transversal dimension of the pipe T. Further, it is assumed that this pipe has to be bent along a curve with a prefixed mean radius Rm. The rigid member 5 according to the invention has a proximal side profile, i. e. near the rotation centre O of the bending die, that comprises a concave intermediate portion. Suitably, in order to conform the pipe T to a desired curvature radius, the concave intermediate portion is that one generated by a section of circumference 50 of a radius Rci, wherein Rci=Rm−(Di/2)+t, t being a term depending on various elements, as mentioned in the following.

Furthermore, according to the invention, the rigid member 5 has a distal side profile with respect to the rotation centre comprising two convex end portions generated by sections of circumference 51, 52 of a radius Rce, wherein Rce=Rm+(Di/2)−t.

This mean radius Rm is generally also the radius of the bending die, i. e. the radius measured from the rotation centre O of the bending die 2 and the longitudinal axis l of the pipe T to be bent. Said rotation centre O and the longitudinal axis l lie in a central plane α, that one of the drawing of FIG. 3, which is orthogonal to a vertical symmetry plane passing through the longitudinal axis l of the pipe T to be bent. The rigid member has a central longitudinal axis α that is perpendicular to the radius Rm and lying in the same central plane α.

The term t depends on the allowance of both the pipe to be bent and the rigid member 5, on the total length of the rigid member 5 and of the single portions thereof in order to permit the rigid member element 5 and the pipe T to be bent to moveably couple together both before and after a bending operation. It is evident that if t increases, the accuracy in bending the pipe T decreases, because the clearance of the pipe T to be bent with respect to the side profile of the rigid member 5 increases. Then, it is understood that, for the purpose of accuracy, it is important that t is near to zero as soon as possible.

Turning to FIG. 3, as one can understand, the superficial intermediate portion generated by the section of circumference 50 and the superficial end portions generated by the sections of circumference 51, 52 are parts of the respective proximal and distal side profiles that interact with the pipe T in the bending operation. On the other hand, the intermediate portion of the distal side profile and the end portions of the proximal side profile can be conformed in such a way that the pipe bending is not affected. Thus, it is suitable that the intermediate portion as generated by a section of circumference 53 opposite to the section of circumference 50 is concave, and the end portions as generated by the sections of circumference 54, 55, opposite to the sections of circumference 51, 52 are convex.

It is preferable that the rigid member 5 has in its real construction symmetrical side profiles, for example of a rotation solid, for bending round pipes, or of an extrusion solid for bending quadrangular pipes, as will be seen below with reference to FIGS. 4 and 5, which show two preferred embodiments of the invention in an assonometric view.

In particular, if symmetrical side profiles with the respect to the symmetry plane passing through the longitudinal axis l of the pipe and perpendicular to the plane α of the drawing are chosen, the intermediate concave portion of the side distal profile will be generated by a section of circumference 53 having the same curvature radius of the section of circumference 50 of the concave intermediate portion of the proximal side profile. As for the convex end portions of the proximal side profile, they will be generated by sections of circumference 54, 55 having the same curvature radius of the sections of circumference 51, 52 of the convex end portions of the distal side profile.

As shown in FIG. 3, from the construction point of view, it is suitable that the sections of circumference 50, 53 of the concave intermediate portions of the proximal side profiles are connected to the sections of circumference 54, 55 and 51, 52 of the respective end portions by means of curves 56, 57. The sections of circumference 51, 52 and 54, 55 of the same end portions of the respective distal and proximal side profiles are reduced toward the ends of the rigid member by means of curves 58, 59, which end with chamfers generally indicated at 60.

Figure 4:
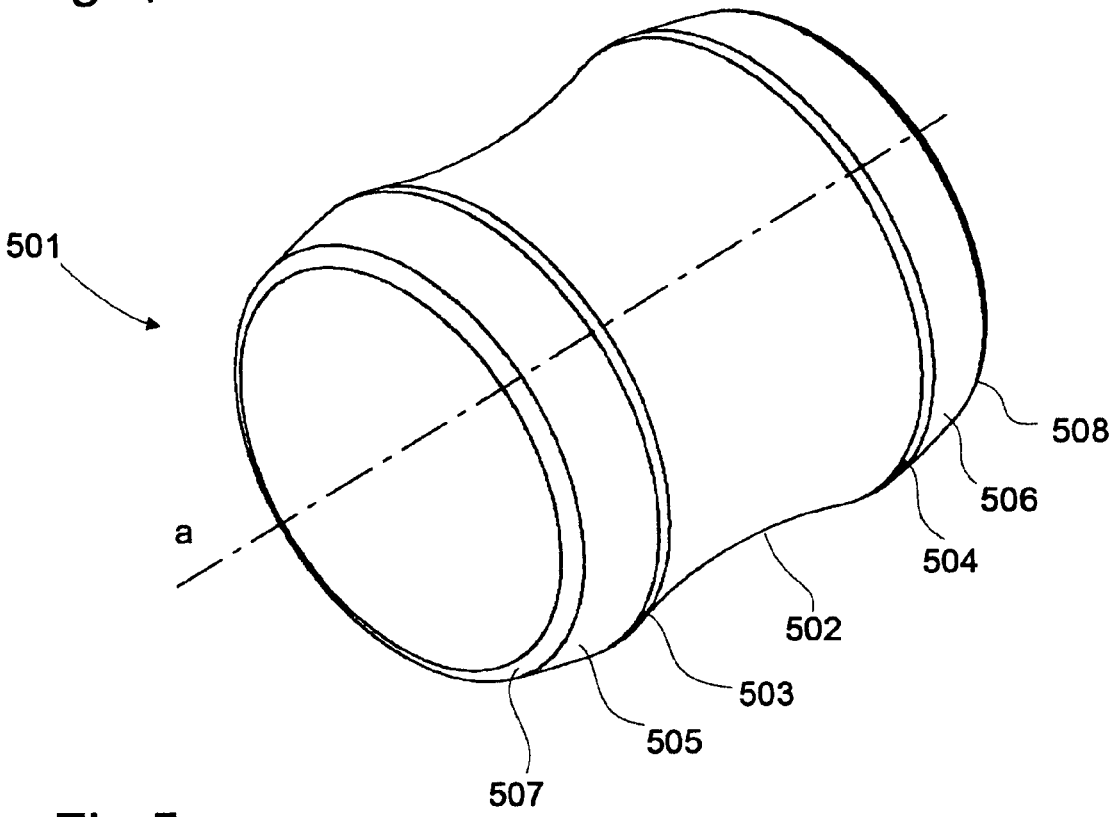
FIG. 4 is an assonometric view of the rigid member of the present invention in a first embodiment thereof for bending pipes with a round cross-section.
Figure 5:
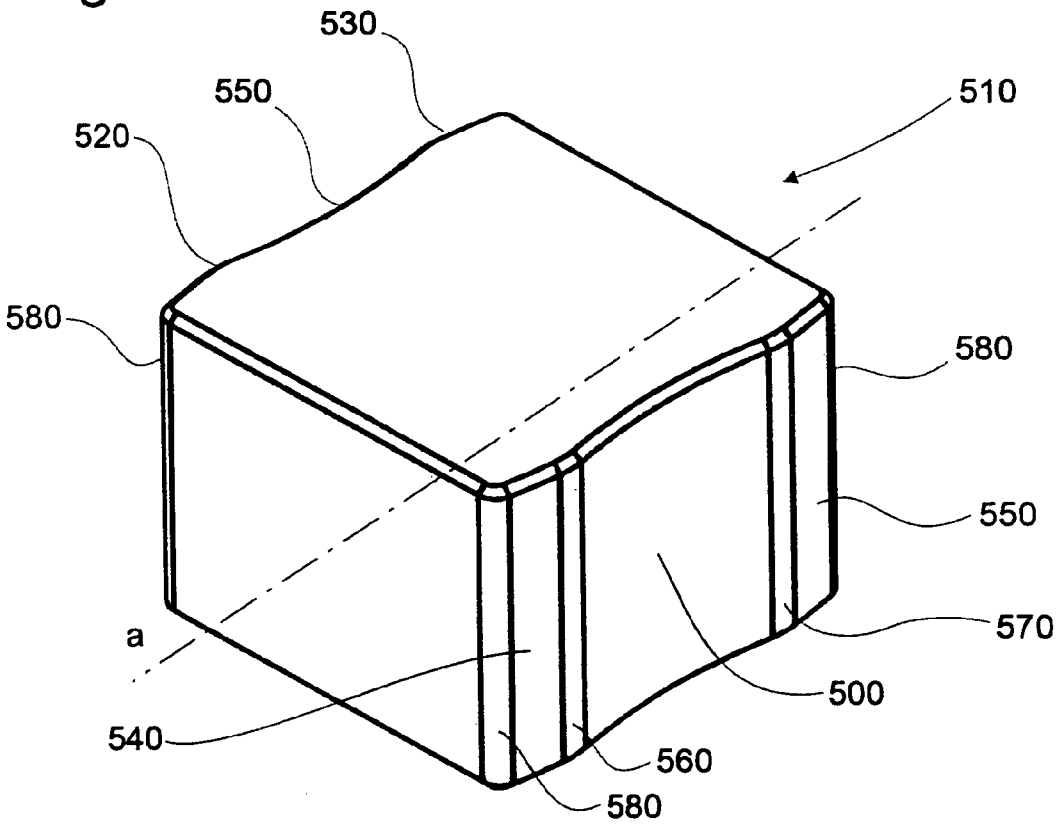
FIG. 5 is an assonometric view of the rigid member of the present invention in a second embodiment thereof for bending pipes with a quadrangular cross-section.

In case of symmetrical side profiles, the rigid member 5 will be substantially conformed as a cylinder 501, as shown in the perspective view in FIG. 4 for bending pipes. The cylinder 501 has a round cross-section with sinusoidal side surfaces, where the concave intermediate portion 502 is generated as a rotation surface by a radius Rci section of circumference rotating about a longitudinal central axis a of the rigid member, and the convex end portions 505, 506 are generated as rotation surfaces by divided, Rce radius sections of circumference rotating about the same longitudinal central axis $\alpha$. The concave intermediate portion 502 is connected to the convex end portions 505, 506 by means of curves indicated at 503 and 504, respectively. The convex end portions 505, 506 terminate at the ends of the rigid member with respective chamfers 507, 508.

For bending quadrangular pipes the rigid member 5 will be substantially conformed as a straight prism 510 having cylindrical side surfaces, differently from the rotation surfaces of the rigid member 501 used in bending round pipes. Such surfaces are indicated at 540, 500, 550 in the proximal side profile and at 520, 550, 530 in the distal side profile, as shown in the perspective view in FIG. 5.

As shown, the concave intermediate surface 500 is reduced by the convex end surfaces 540, 550 of the proximal side by means of respective curves 560, 570, which cannot be seen in the distal side and terminate at the end of the rigid member 510 with chamfers generally indicated at 580.

Even if until now the definition of proximal and distal is kept for the side profiles, it should be evident that, in case of symmetrical side profiles of the rigid member, indicating these profiles as such doesn't mean anything because, in the embodiment in FIG. 4, the rigid member 501 has all its side profiles that are the same, as it is a rotation solid, and the rigid member 510 has the side profile and the distal profile replaceable with each other, because they are the same.

With reference again to FIG. 1, an embodiment for the mandrel according to the present invention will be described in detail. The not flexible main body 3 is connected at the rear end to the mandrel holding rod 4 (only partially shown), whose functions are known and then no longer described.

The rigid member 5 is articulated at the front end 30 of the not flexible main body 3. As before said, an articulated connection of the rigid member 5 with the not flexible main body 3 is described below, although it should be understood that any other connection, able to tilt the rigid member 5 with respect to the not flexible main body, can be used.

Suitably, the not flexible main body 3 has at its front end 30 a housing 31 which configured in a known way so that it comprises also a female part of a ball joint. On the housing 31 a radial hole 32 is made to allow a dowel (not shown) to be screwed in it.

In a known way, the male part of the ball joint in the form of a first protuberance 6 has a spherical shape having a square front face. From this square face, the first protuberance 6 is worked circumferentially to obtain a cylindrical central portion having a radius less than the spherical one. Further, in the first protuberance 6 a large threaded through-hole is performed, not shown, for a connecting shaft 7. By virtue of this configuration of the first protuberance 6, it can be promptly inserted in the housing 31 in a spherical recess thereof, the first protuberance 6 having sizes less than the radius of the same spherical recess. The first protuberance 6 is put in the spherical recess after applying a helicoid spring 8 in a cylindrical back chamber of the housing 31. The first protuberance 6, after being put in the spherical recess, is rotated to allow the connecting shaft 7 to be screwed readily in the first protuberance 6. Then, the connecting shaft 7 is locked inside the first protuberance 6 by means of a dowel screwed through the radial hole 32.

A second protuberance 9 is fixed to the other end of the connecting shaft 7, for example also by means of a screwed dowel. Advantageously, the rigid member 5 has a face 10 facing the front end 30 of the not flexible main body 3. A double cylindrical cavity, the one external cavity 11 having a greater diameter, the other internal cavity 12 having a smaller diameter, is performed centrally on the face 10 of the rigid member 5. The external cavity 11 is threaded, and a retaining bush 13 is screwed into the external cavity 11. The retaining bush 13 has a through hole which is frontally conformed as a hemisphere and is provided at the rear with a frustoconical mouth 14 facing opposite to the entrance of the housing 31.

Housed in the internal cavity 12 of the rigid member 5 is a helicoid spring 15, that by a ball 16 charges a second protuberance 9, when the latter is inserted in the retainer bush 13. The rigid member, being spring-charged at its end in rest condition with this arrangement of the connecting shaft 7, tends to assume a straight position with the body 3.

The rigid member 5 can be manufactured either integral or in many parts that are securely connected together so that one body is formed.

In the above description only an illustrative and not limiting embodiment of connection between the main body and the rigid member is given, but it must be clear that the invention is not bound to that one.

What is claimed is:

1. A pipe-bending machine mandrel, comprising:

a rigid member configured to be inserted inside a pipe to be bent and to tilt in a bending operation which is performed by a bending die in order to obtain a curve having a prefixed mean radius Rm as measured between a rotation centre of the bending die and a longitudinal axis of the pipe to be bent, said mean radius Rm and longitudinal axis lying in a central plane orthogonal to a symmetry plane of the pipe to be bent passing through its longitudinal axis, said pipe to be bent having an internal dimension Di as measured transversally to the pipe's longitudinal axis, wherein the rigid member has a proximal side profile with respect to the rotation centre of the bending die comprising at least a concave intermediate portion as generated by a radius Rci section of circumference rotating about a longitudinal central axis of the rigid member, and a distal side profile with respect to the rotation centre of the bending die comprising at least two convex, divided, end portions as generated by respective radius Rce sections of circumference, where Rci=Rm−(Di/2)+t, and Rce=Rm+(Di/2)−t, t varying according to an accuracy of dimensional characteristics of the pipe to be bent and of the curve to be obtained, and wherein said pipe to be bent has a quadrangular cross-section, and said intermediate portion and said end portions of the rigid member are portions of an extrusion surface generated by said sections of circumference in their shift parallel to said symmetry plane of the pipe to be bent.

2. The mandrel according to claim 1, wherein said rigid member has both proximal and distal side profiles that are symmetrical with respect to said symmetry plane of the pipe, each side profile comprising a concave intermediate portion as generated by a radius Rci section of circumference, between two convex end portions as generated by radius Rce sections of circumference, the intermediate portion being mutually radiused to the two end portions of the rigid member, which are chamfered at the ends of the rigid member.

3. The mandrel according to claim 1, wherein said pipe to be bent has a round cross-section, and said intermediate portion and said end portions of the rigid member are portions of a rotation surface as generated by said sections of circumference about a central longitudinal axis of the rigid member.

4. The mandrel according to claim 1, wherein said rigid member is articulated with respect to a not flexible main body connected to a mandrel holding rod.

5. The mandrel according to claim 4, wherein said rigid member and said not flexible main body are mutually connected by a connecting shaft terminating with spherical end protuberances received into respective housings arranged in opposite portions of said not flexible main body and of said rigid member for forming co-operating ball joints.

6. A pipe-bending machine mandrel, comprising:

a rigid member configured to be inserted inside a pipe to be bent and to tilt in a bending operation which is performed by a bending die in order to obtain a curve having a prefixed mean radius Rm as measured between a rotation centre of the bending die and a longitudinal axis of the pipe to be bent, said mean radius Rm and longitudinal axis lying in a central plane orthogonal to a symmetry plane of the pipe to be bent passing through its longitudinal axis, said pipe to be bent having an internal dimension Di as measured transversally to the pipe's longitudinal axis, wherein the rigid member has a proximal side profile with respect to the rotation centre of the bending die comprising at least a concave intermediate portion as generated by a radius Rci section of circumference rotating about a longitudinal central axis of the rigid member, and a distal side profile with respect to the rotation centre of the bending die comprising at least two convex, divided, end portions as generated by respective radius Rce sections of circumference, where $Rci=Rm-(Di/2)=t$, and $Rce=Rm+(Di/2)-t$, t varying according to an accuracy of dimensional characteristics of the pipe to be bent and of the curve to be obtained, and said rigid member is articulated with respect to a not flexible main body connected to a mandrel holding rod, said rigid member and said not flexible main body being mutually connected by a connecting shaft terminating with spherical end protuberances received into respective housings arranged in opposite portions of said not flexible main body and of said rigid member for forming cooperating ball joints, and said spherical end protuberances of the connecting shaft are spring-charged in said respective housings.

7. The mandrel according to claim 1, wherein said rigid member is manufactured integral.

8. The mandrel according to claim 1, wherein said rigid member is manufactured in a plurality of parts that are securely connected together for forming a single body.

* * * * *